US007497329B2

(12) United States Patent
Hasegawa et al.

(10) Patent No.: US 7,497,329 B2
(45) Date of Patent: Mar. 3, 2009

(54) STAPLE CASE

(75) Inventors: Takao Hasegawa, Tokyo (JP); Tomoaki Sakata, Tokyo (JP)

(73) Assignee: Max Co., Ltd., Tokyo (JP)

( * ) Notice: Subject to any disclaimer, the term of this patent is extended or adjusted under 35 U.S.C. 154(b) by 159 days.

(21) Appl. No.: 10/530,563

(22) PCT Filed: Oct. 7, 2003

(86) PCT No.: PCT/JP03/12843

§ 371 (c)(1),
(2), (4) Date: Apr. 7, 2005

(87) PCT Pub. No.: WO2004/033157

PCT Pub. Date: Apr. 22, 2004

(65) Prior Publication Data

US 2006/0054653 A1 Mar. 16, 2006

(30) Foreign Application Priority Data

Oct. 9, 2002 (JP) ..... 2002-296674
Oct. 9, 2002 (JP) ..... 2002-296679

(51) Int. Cl.
*B65D 85/24* (2006.01)
*B25C 5/00* (2006.01)

(52) U.S. Cl. ..... 206/340; 227/120

(58) Field of Classification Search ..... 206/340; 227/119, 120, 131, 136
See application file for complete search history.

(56) References Cited

U.S. PATENT DOCUMENTS 3,009,618 A * 11/1961 Lerner ..... 226/162
3,602,414 A * 8/1971 Garfinkel ..... 226/151
5,273,199 A * 12/1993 Logtens ..... 227/87
5,794,833 A * 8/1998 Straat ..... 227/137
6,039,230 A * 3/2000 Yagi et al. ..... 227/120
6,371,352 B1 4/2002 Mochizuke
6,568,579 B2 * 5/2003 Mochizuki ..... 227/131
D504,295 S * 4/2005 Haramiishi ..... D8/49
6,913,181 B2 * 7/2005 Mochizuki et al. ..... 227/120
7,048,165 B2 * 5/2006 Haramiishi ..... 227/3

FOREIGN PATENT DOCUMENTS

| | | | |
|---|---|---|---|
| EP | 1 175 979 | A2 | 1/2002 |
| JP | 59-45482 | B2 | 11/1984 |
| JP | 9-136271 | A | 5/1997 |
| JP | 2689840 | B2 | 8/1997 |
| JP | 2000-27823 | A | 1/2000 |
| JP | 2000-167782 | A | 6/2000 |

(Continued)

*Primary Examiner*—Mickey Yu
*Assistant Examiner*—Steven A. Reynolds
(74) *Attorney, Agent, or Firm*—Morgan Lewis & Bockius LLP

(57) ABSTRACT

In a staple case provided with a staple pull-out opening and a lower face opening, a roll staple is contained, so that the staple case can be directly installed in a staple cartridge. When the staple cartridge is loaded in an electric stapler, a staple-feeding roller is in contact with the roll staple. As the staple-feeding roller rotationally drives the roll staple, a leading edge of the roll staple is fed to a leading edge of a guide portion of the staple cartridge through the staple pull-out opening.

12 Claims, 19 Drawing Sheets

FOREIGN PATENT DOCUMENTS

| | | |
|---|---|---|
| JP | 2000-354980 | 12/2000 |
| JP | 2001-347474 A | 12/2001 |
| JP | 2002-120166 | 4/2002 |
| JP | 2002-200575 | 7/2002 |
| JP | 2002-200575 A | 7/2002 |

* cited by examiner

STAPLE CASE

TECHNICAL FIELD

The present invention relates to a refillable staple case used for a stapler, and more specifically, a staple case that is made easy to be handled.

BACKGROUND ART

Conventionally, a disposable staple cartridge the entirety of which is replaced when staples in the staple cartridge for a stapler used up is generally used. However, so as to save resources and reduce waste, switch to a refillable staple cartridge in which staples can be refilled is being advanced.

There exist a staple cartridge that contains a staple sheet pack including layers of sheet staples formed by connecting unformed staples flat, and a staple cartridge that contains a roll staple. For example, as disclosed in JP-B2-2689840 (paragraph number 0010, FIG. 4), layered sheet staples contained in a box-shaped staple case made of plastic or paper are provided as refills. In addition, disclosed in JP-A-09-136271 (paragraph number 0068, FIG. 2) is a roll staple in which a rolled form is kept by affixing an outer circumferential ends of the staples to an outer circumferential surface of the roll by an adhesive tape. When the roll staple is to be used, the adhesive tape is removed and the roll staple is loaded in a cartridge by making its leading edge free.

The conventional roll staple is used by being loaded in a plastic cartridge, however, when the adhesive tape adhering to the outer circumference of the roll staple is removed and the staples are loaded in a cartridge, the roll may be unrolled and it takes time to reroll it, or the roll staple may be broken by being dropped by mistake and become unusable. Therefore, handling thereof is difficult. In addition, it is necessary to insert the leading edge of the roll staple to a guide path that guides the leading edge to a driving portion of a stapler when the roll staple is loaded. Therefore, loading takes time.

Furthermore, the roll staple is shipped by being put in a paper box, and packing materials are filled in a space inside the paper box to prevent the staple from being broken during transportation. However, after the roll staple is taken out of the paper box, these packaging materials become useless and are thrown away, so that resources are wasted considerably. In addition, when using a container made by folding a paper as described in JP-B2-2689840, sheet staples contained inside dispersed into pieces or are broken when the container is dropped. Furthermore, the orientation of the staples inside the staple case is difficult to be known, and there is a possibility that they are loaded in reverse.

DISCLOSURE OF THE INVENTION

Therefore, there is a technical problem that should be solved to make the roll staple loading operation easy, and the invention solves this problem.

In addition, an object of the invention is to make handling of staples easy and eliminate the resource waste by omitting the packaging materials.

The invention proposes to achieve the above-mentioned object, and provides a staple case containing a roll staple formed by connecting unformed staples in a rolled shape.

In addition, the invention proposes a staple case provided with a pull-out opening through which the roll staple contained in the staple case is pulled out.

In addition, the invention proposes a staple case with an opening that is formed in a part of the staple case facing the circumferential surface of the contained roll staple and a member for rotating the roll staple faces.

The invention proposes a staple case formed by joining case halves molded by being divided into two, and a staple case provided with a weak portion at the joint between the two case halves so that the two case halves can be split.

Furthermore, the invention proposes a staple case for containing staples to be used for a stapler, provided with cushion portions on the staple case.

In addition, the invention proposes a staple case for containing staples to be used for a stapler, provided with a portion for positioning in a containing chamber.

Furthermore, the invention proposes a staple case for containing staples to be used for a stapler, provided with a guide portion for guiding the staple case to the containing chamber.

Furthermore, the invention proposes a staple case formed by joining case halves molded by being divided into two.

Furthermore, the invention proposes a staple case provided with a weak portion on the joint between the two case halves so that the two case halves can be split.

Furthermore, the invention proposes a staple case which indicates a mark showing the direction of insertion into a stapler on the side face, and limits the direction of insertion into the stapler to one direction by differing the faces of at least one of the pair of upper and bottom faces and the pair of the front and back faces from each other.

Figure 1:
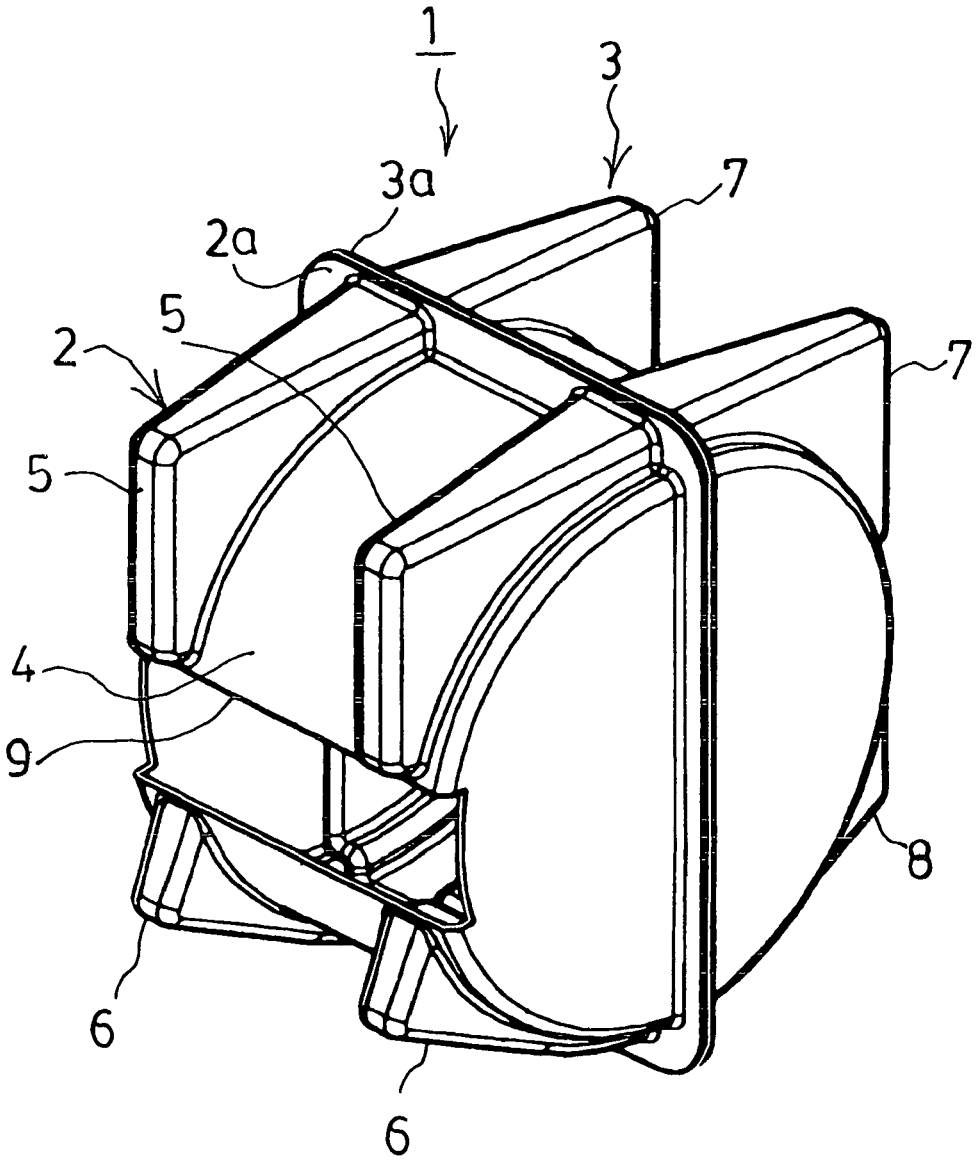
FIG. 1 is a perspective view of a staple case according to the first embodiment of the invention.

In the figures, the reference numeral 1 denotes a staple case, 2 denotes a front side case half, 3 denotes a rear side case half, 4 denotes a roll staple containing chamber, 5, 6, 7, and 8 denote cushion portions, 9 denotes a staple pull-out opening, 10 denotes an opening, 12 denotes a staple feeding roller, 13 denotes a guide portion, 21 denotes a staple case, 22 denotes a front side case half, 23 denotes a staple pull-out opening, 24 denotes a rear side case half, 25 denotes an opening, 31 denotes a staple case, 32 denotes a roll staple containing chamber, 33 denotes a receiving portion, 34 denotes an opening, 35 denotes a staple pull-out opening, 101 denotes a staple case, 102 denotes a front side case half, 103 denotes a rear side case half, 104 denotes a roll staple containing chamber, 105, 106, 107, and 108 denote cushion portions, 109 denotes a staple pull-out opening, 110 denotes a mark, 111 denotes a cushion portion, 121 denotes a staple case, 122 denotes a cushion portion, 123 denotes a cushion portion, 124 denotes an opening, 125 denotes a staple pull-out opening, S denotes a roll staple, and C denotes a staple cartridge.

BEST MODE FOR CARRYING OUT THE INVENTION

Hereinafter, embodiments of this invention are described in detail with reference to the accompanying drawings.

FIRST EMBODIMENT

Figure 2:
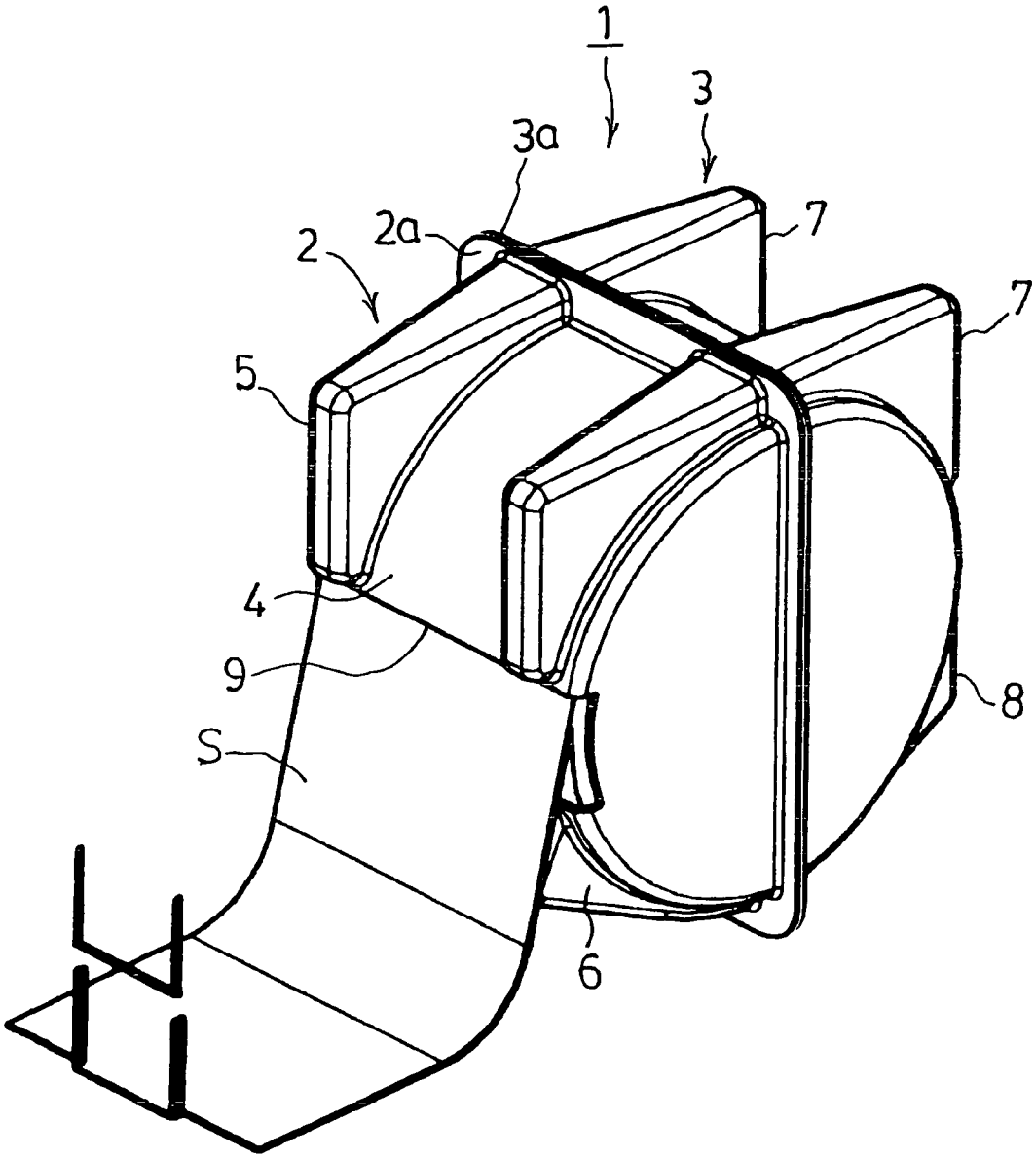
FIG. 2 is a perspective view showing a condition where a staple is pulled out of the staple case according to the first embodiment of the invention.
Figure 3:
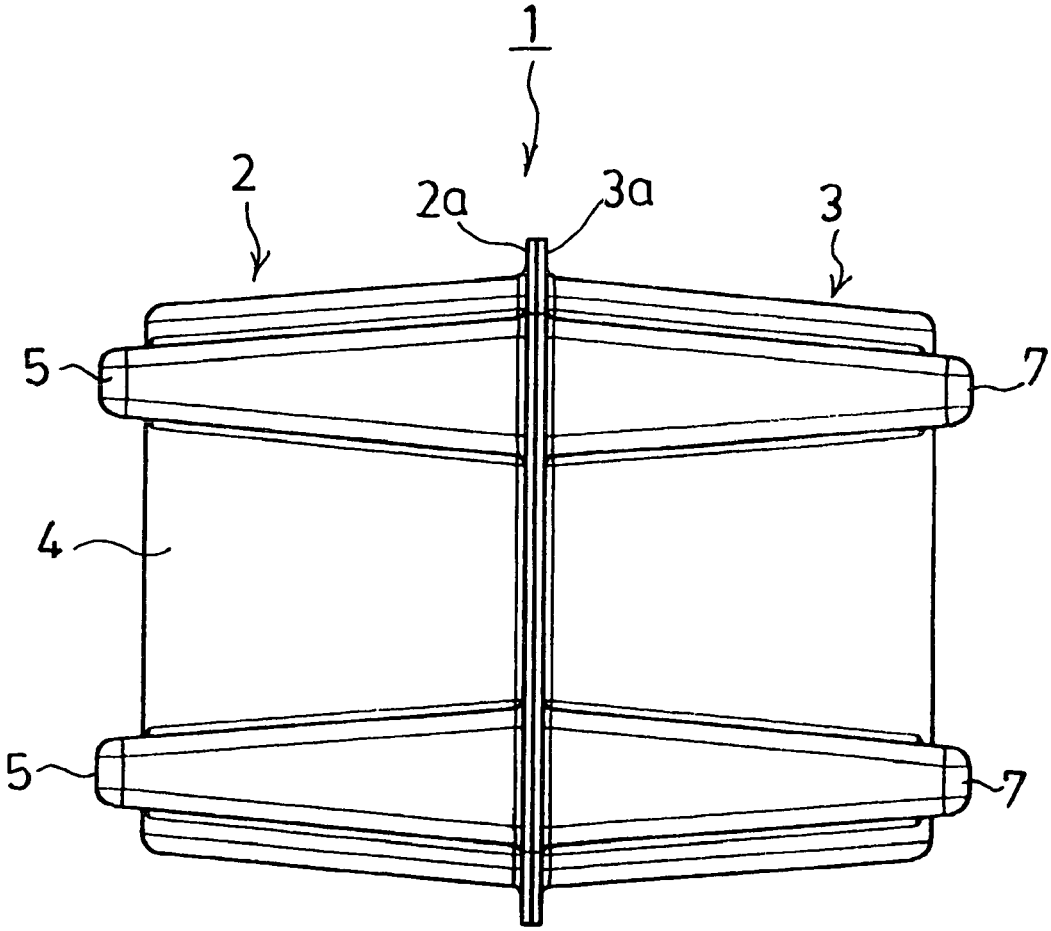
FIG. 3 is a plan view of the staple case according to the first embodiment of the invention.

FIG. 1 shows an empty staple case 1 according to a first embodiment of the invention, and FIG. 2 shows a condition where the leading edge of the roll staple S contained in the staple case 1 is pulled out. The staple case 1 is split into two at the center of the front and rear direction, a front side case half 2 and a rear side case half 3 are molded by means of blow molding or vacuum molding by using a sheet material such as a calcium carbonate-containing polypropylene sheet or the like, and the roll staple S is contained in the hollow columnar roll staple containing chamber 4 formed by the front side case half 2 and the rear side case half 3, and flange portions 2*a* and 3*a* of the front side case half 2 and the rear side case half 3 are bonded to each other.

As shown in FIG. 1 through FIG. 7, on both left and right side faces inside the roll staple containing chamber 4, hollow cushion portions 5, 6, 7, and 8 roughly squared as a whole are formed. When one or a plurality of staple cases 1 are contained in a paper box with a capacity that conform to the external dimensions of the staple case 1, the squared cushion portions 5, 6, 7, and 8 serve as packing materials and prevent the staple cases 1 from moving inside the paper box. When an impact is applied from the outside, the cushion portions 5, 6, 7, and 8 prevent the roll staple S from being broken by absorbing the impact. In addition, by using a single material such as a calcium carbonate-containing polypropylene sheet or the like as the material of the staple case 1, when the staple case is incinerated, generation of toxic gases is prevented and the staple case can be disposed as flammable garbage.

Figure 4:
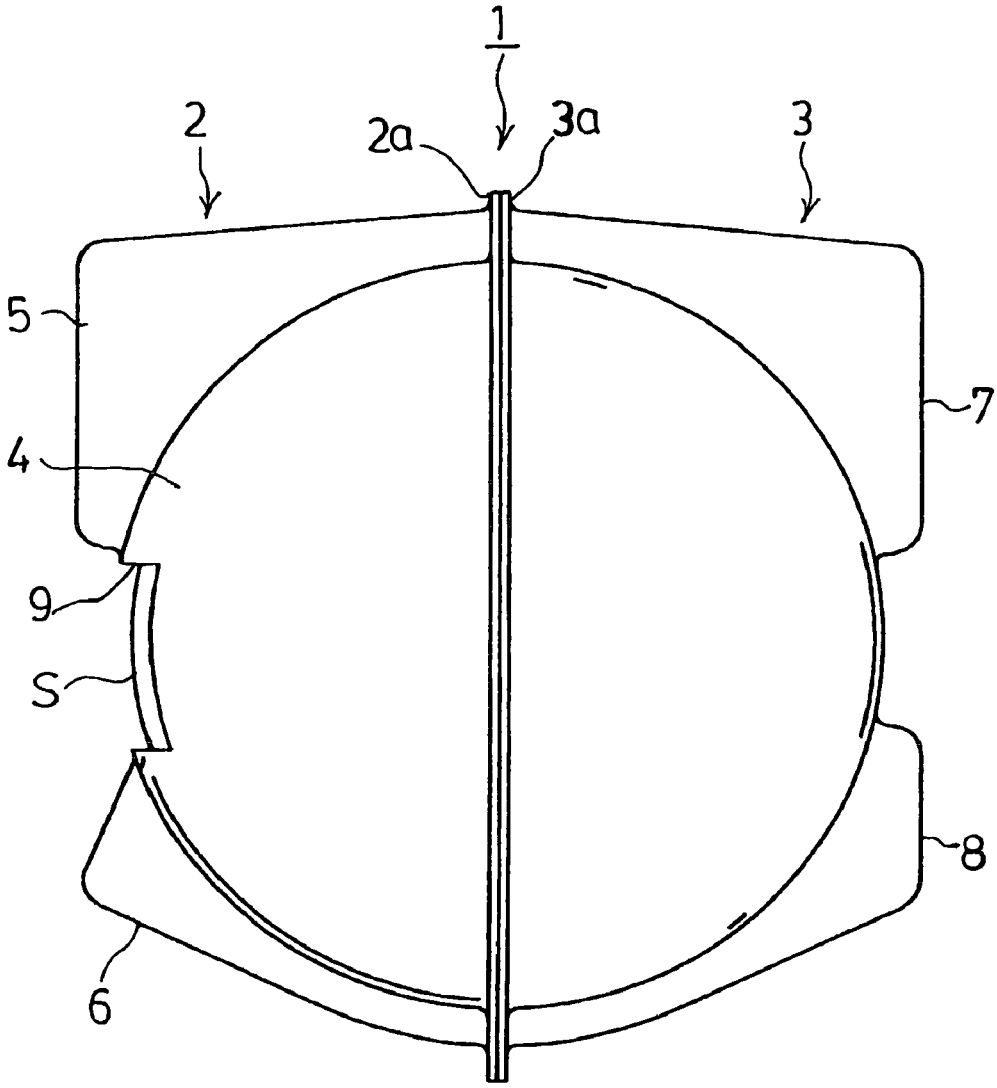
FIG. 4 is a side view of the staple case according to the first embodiment of the invention.
Figure 5:
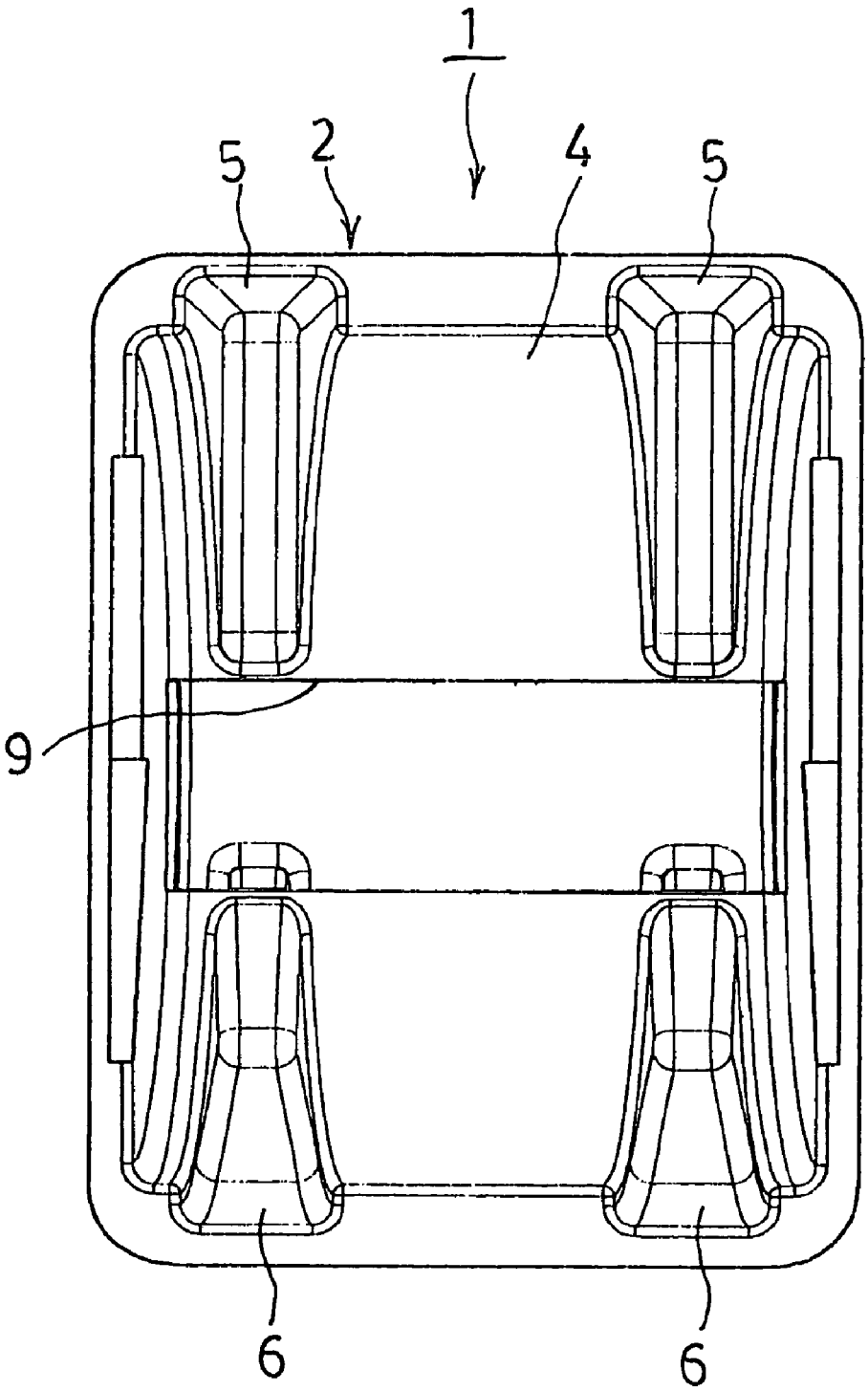
FIG. 5 is a front view of the staple case according to the first embodiment of the invention.
Figure 6:
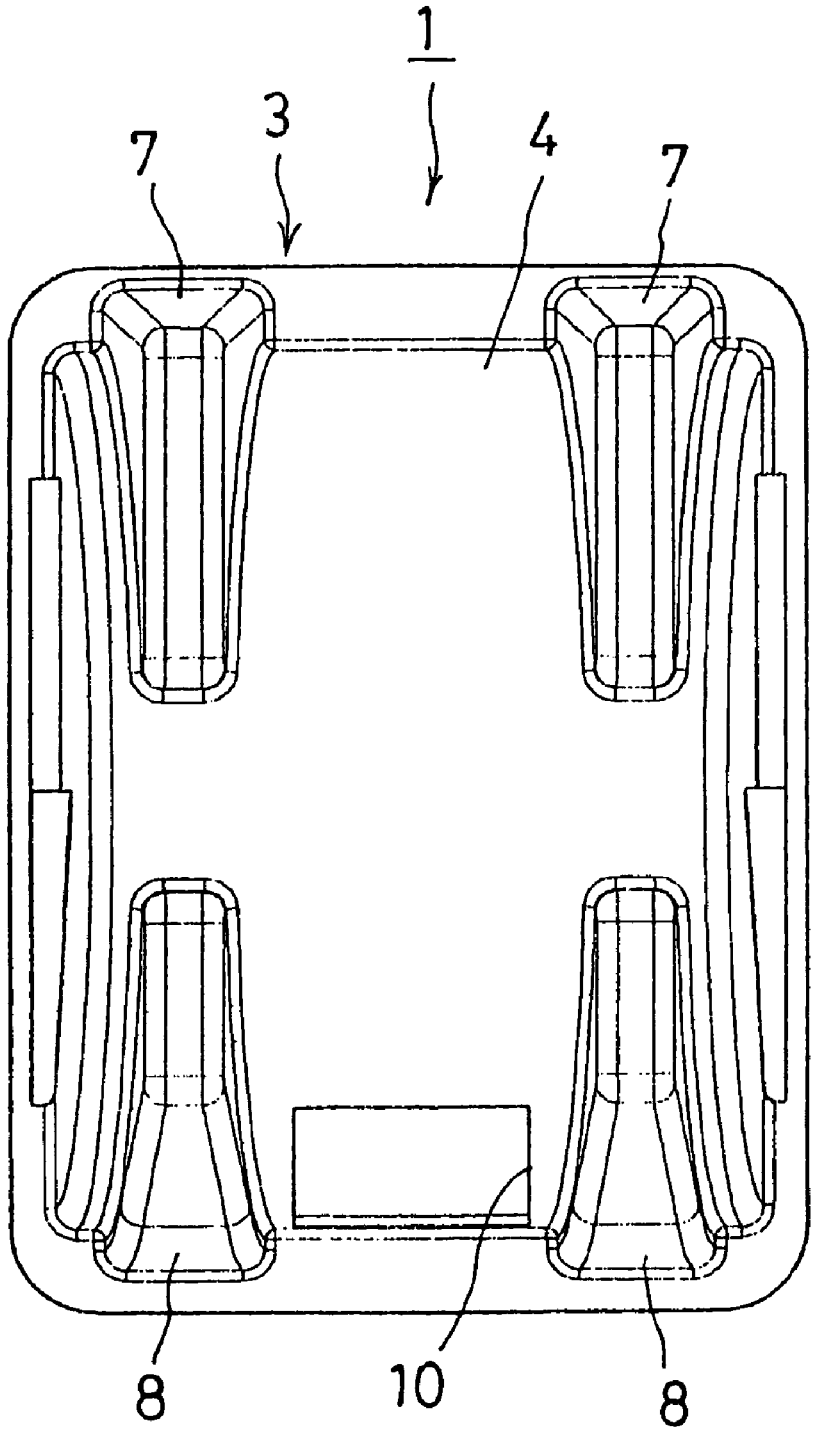
FIG. 6 is a back view of the staple case according to the first embodiment of the invention.
Figure 7:
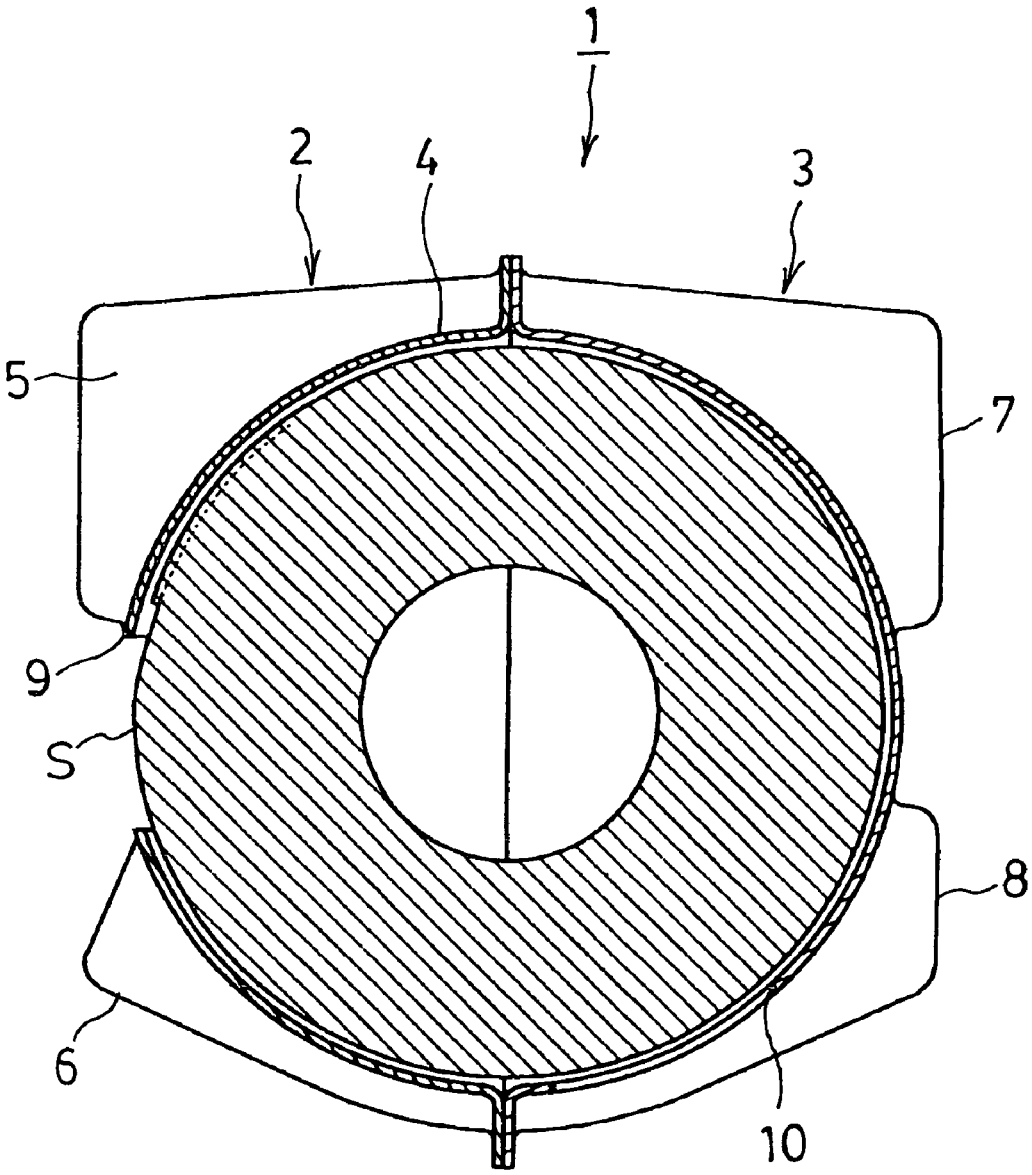
FIG. 7 is a side sectional view of the staple case according to the first embodiment of the invention.

At the vertical center of the front face of the front side case half 2, a staple pull-out opening 9 is opened, and the roll staple S is pulled out through the staple pull-out opening 9. This staple pull-out opening 9 may be formed by forming perforations or thinned portions on the staple case 1 and removing these before use. As shown in FIG. 1 and FIG. 4, the front surfaces of the front side lower cushion portions 6 below the staple pull-out opening 9 are sloped down to the front side from the staple pull-out opening 9 so that a staple is smoothly pulled out. In addition, as shown in FIG. 6 and FIG. 7, a rectangular opening 10 is formed in the bottom face of the roll staple containing chamber portion of the rear side case half 3. This opening 10 may also be formed by forming a weak portion such as perforations or thinned portions on the staple case and removing this portion before use.

Figure 8A:
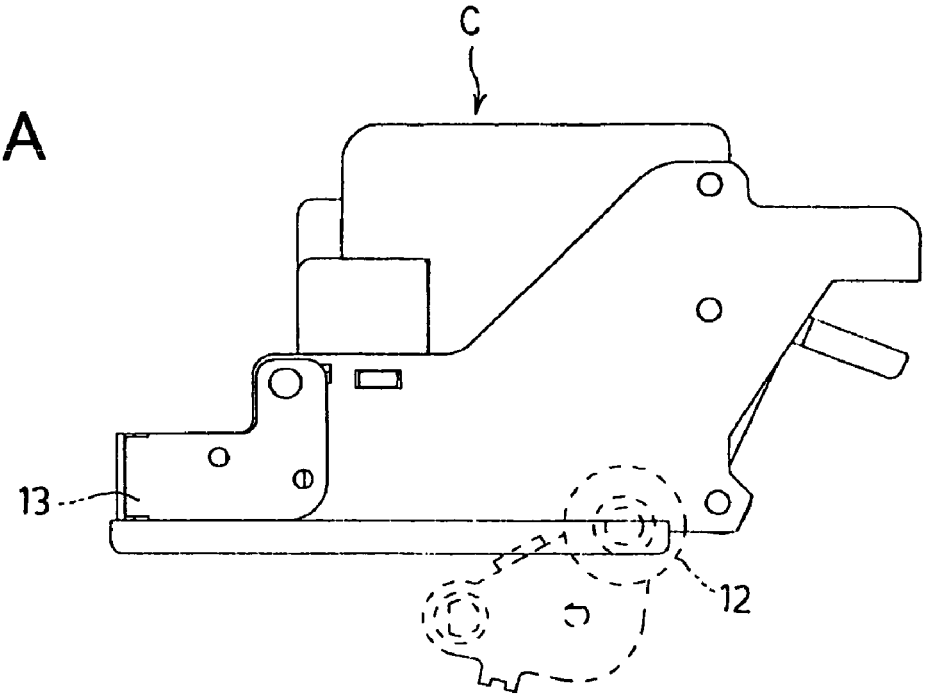
FIG. 8A is a side view of the staple case according to the first embodiment of the invention and a staple cartridge to contain the staple case.
Figure 8B:
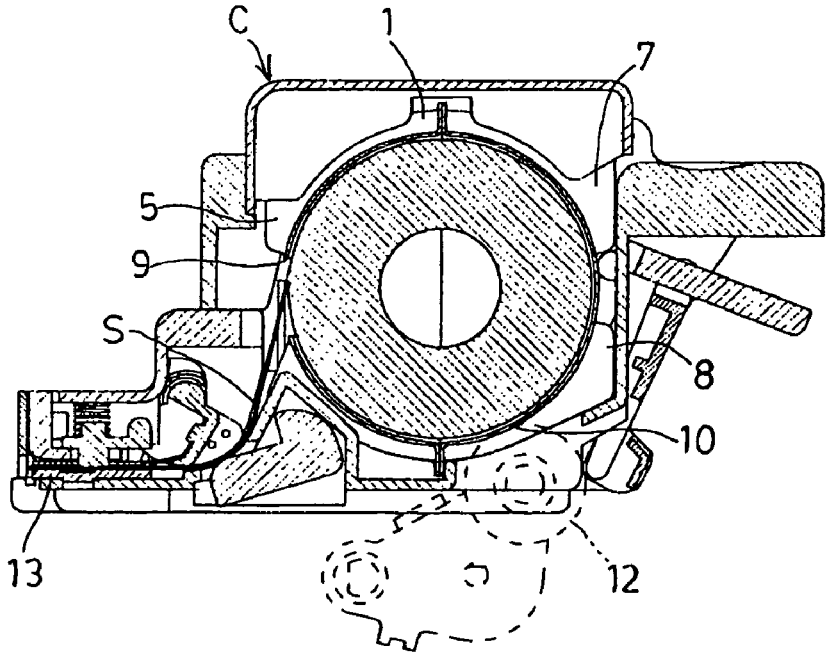
FIG. 8B is a side sectional view of the staple case according to the first embodiment of the invention and a staple cartridge to contain the staple case.

FIG. 8A and FIG. 8B show a staple cartridge C, wherein the staple containing chamber 11 of the staple cartridge C has a shape and dimensions suitable for the staple case 1. The inner bottom surface is formed into a concave surface matching the shapes of the cushion portions 6 and 8 of the staple case 1. An electric stapler (not shown) has a staple forming and driving means to be driven by a motor, a cartridge chamber in which a cartridge C containing a staple case is loaded, and a staple clinch mechanism, wherein a staple feeding roller 12 is provided below the cartridge chamber. When a staple cartridge C is loaded in the cartridge chamber, the staple feeding roller 12 comes into contact with the roll staple S through the lower face opening 10 of the staple case 1.

The electric stapler is provided with a cartridge detection sensor. When a staple cartridge C is loaded, the staple feeding roller 12 starts and rotates the roll staple S counterclockwise in the figures. Thereby, the leading edge of the roll staple S is pushed out of the staple pull-out opening 9, and fed to the driver path on the fore end through the cushion portions 6 on the front lower side and the guide portion 13 of the staple cartridge C, and formed into a C shape by a forming plate of the electric stapler so as to enable stapling. Herein, an electric stapler is described as an example, however, a manual stapler that has a cartridge chamber and a staple feed means, etc., and carries out manual forming and stapling is also possible.

SECOND EMBODIMENT

Figure 9:
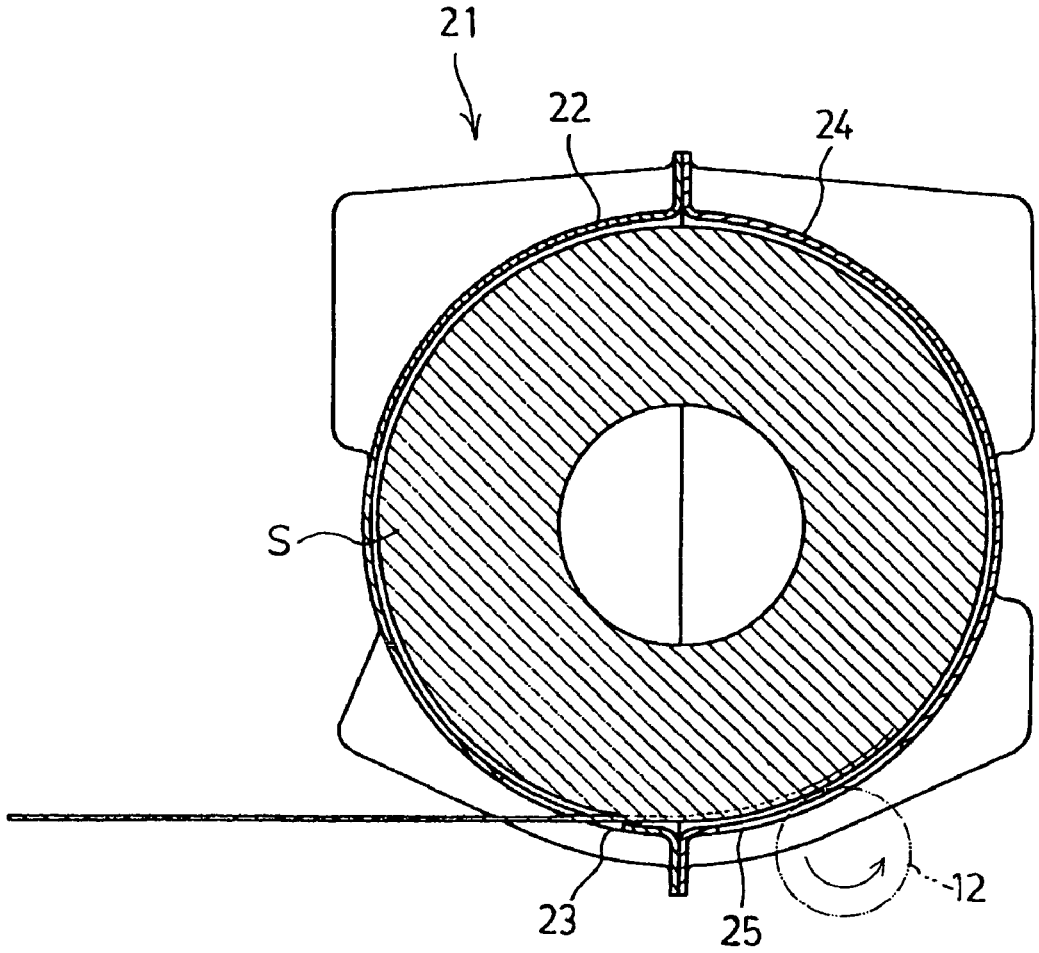
FIG. 9 is a side sectional view of a staple case according to a second embodiment of the invention.

FIG. 9 shows a second embodiment of the invention, wherein a staple case 21 is provided with a staple pull-out opening 23 in the bottom face of a front side case half 22, and as in the case with the above-mentioned embodiment, a staple feeding roller 12 is brought into contact with the roll staple S through an opening 25 opened in the bottom face of a rear side case half 24. In this staple case 21, the roll staple S is driven to rotate clockwise in the figure, whereby the leading edge of the roll staple S is pushed forward out of the staple pull-out opening 23, and a staple is automatically set in the staple cartridge.

The external shapes of the staple cases 1 and 21 are shaped by providing a cylindrical shape fitting the outer circumference of the cylindrical roll staple with cushion portions. However, it is also possible that they are shaped into cylinders provided with substantially even cushion portions on the outer circumference of the roll staple containing chamber.

THIRD EMBODIMENT

Figure 10:
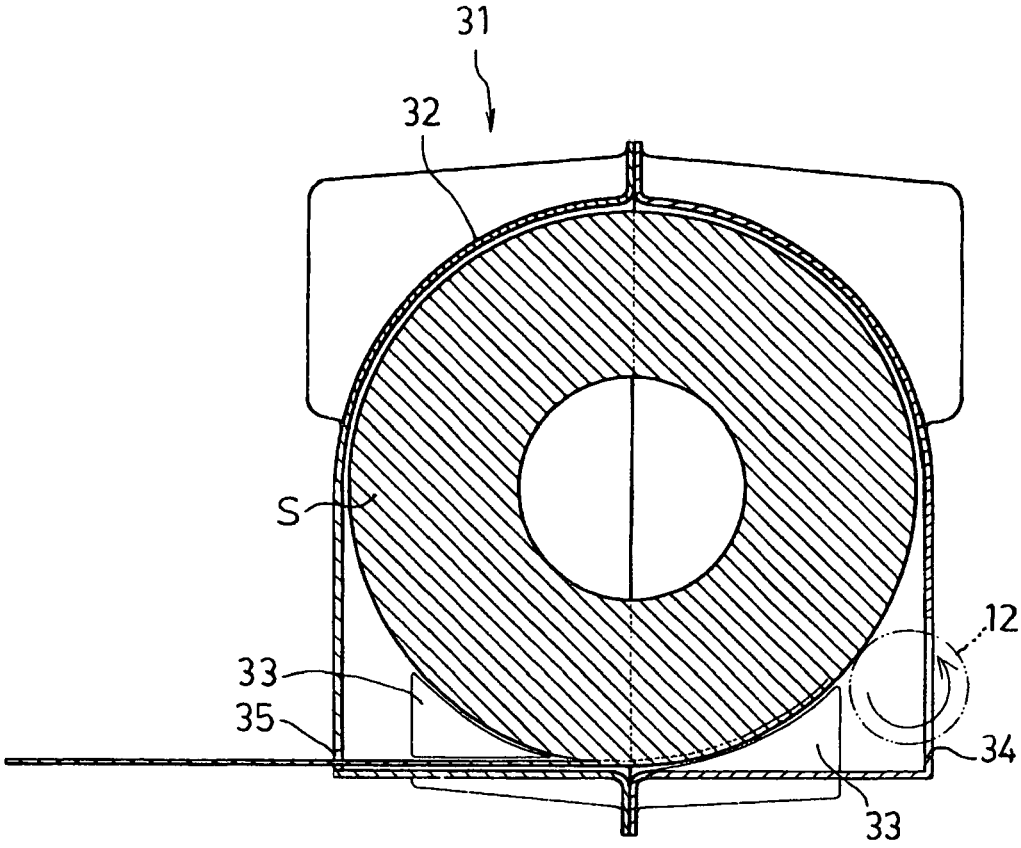
FIG. 10 is a side sectional view of a staple case according to a third embodiment of the invention.

FIG. 10 shows a third embodiment of the invention, wherein the staple chamber 32 of the staple case 31 is formed so that its upper portion is curved so as to fit the outer circumference of the roll staple and its lower portion is squared for stability. Inside the lower portion, receivers. 33 with curved surfaces for supporting the roll staple are formed. In the figure, on the lower right of the staple case 31, an opening 34 for receiving a staple feeding roller 12 is formed. On the lower left, a staple pull-out opening 35 is formed.

FOURTH EMBODIMENT

Figure 11:
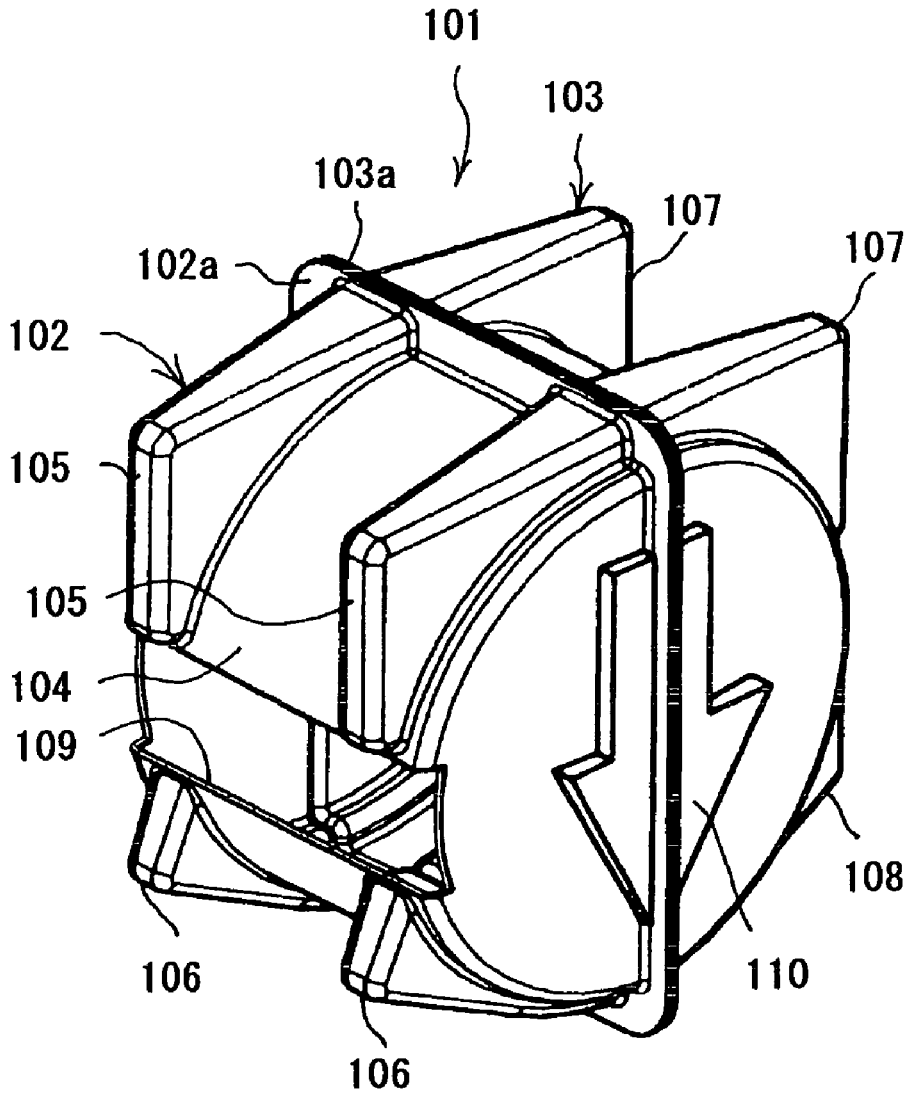
FIG. 11 is a perspective view of a staple case according to a fourth embodiment of the invention.
Figure 12:
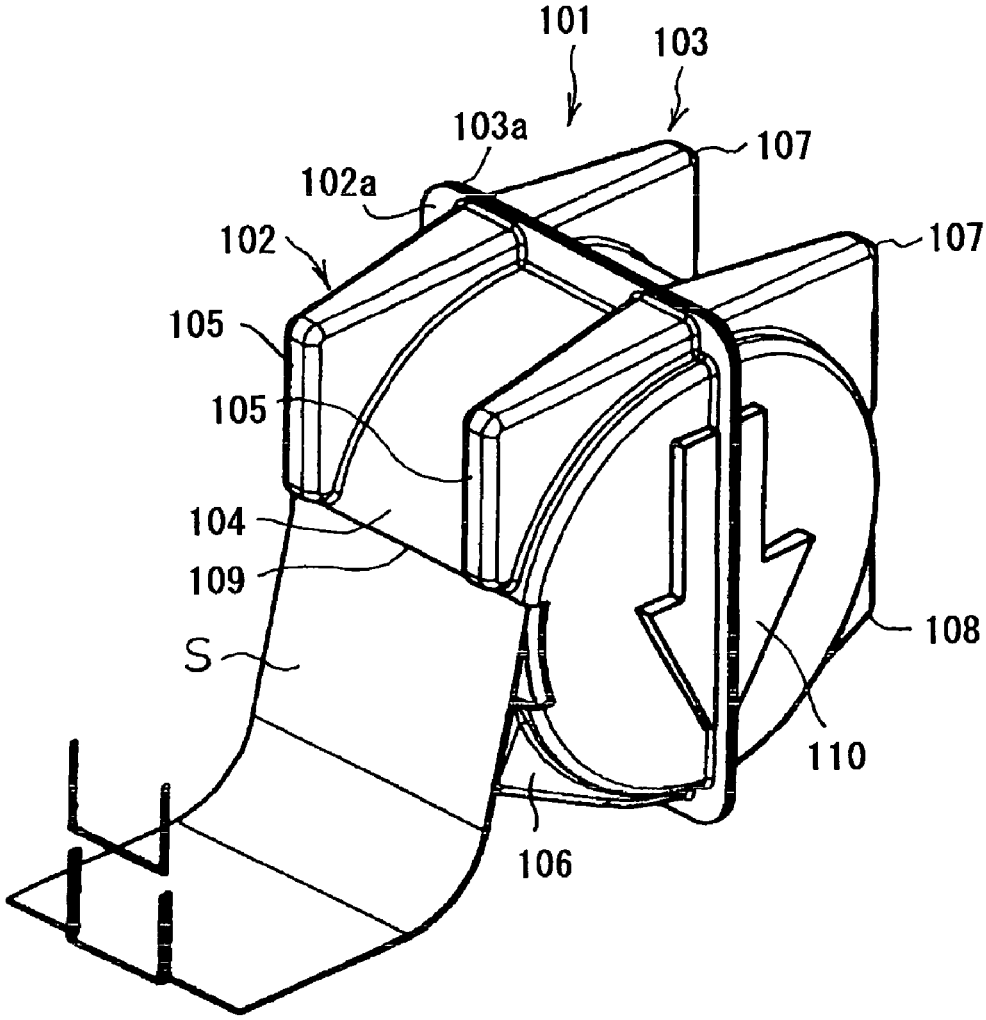
FIG. 12 is a perspective view showing a condition where a staple is pulled out of the staple case according to the fourth embodiment of the invention.
Figure 13:
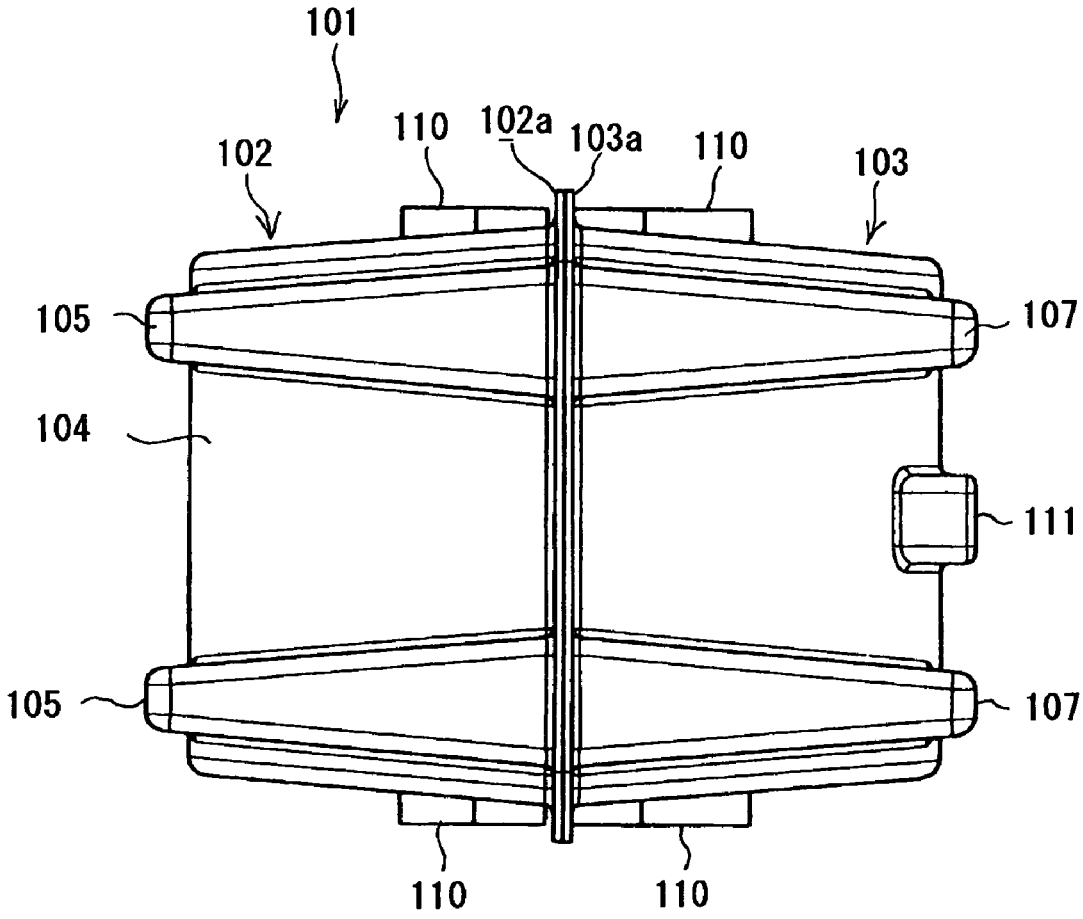
FIG. 13 is a plan view of the staple case according to the fourth embodiment of the invention.

FIG. 11 shows an empty staple case 101 according to a fourth embodiment of the invention, and FIG. 12 shows a condition where the leading edge of the roll staple S contained in the staple case 101 is pulled out. The staple case 101 is split vertically at the center of the cross direction, and a front side case half 102 and a rear side case half 103 are molded by means of blow molding or vacuum molding by using a sheet material such as a calcium carbonate-containing polypropylene sheet or the like. Flange portions 102*a* and 103*a* of the front side case half 102 and the rear side case half 103 are bonded after containing the roll staple S inside the hollow cylindrical roll staple containing chamber 104 formed of the front side case half 102 and the rear side case half 103.

Figure 14:
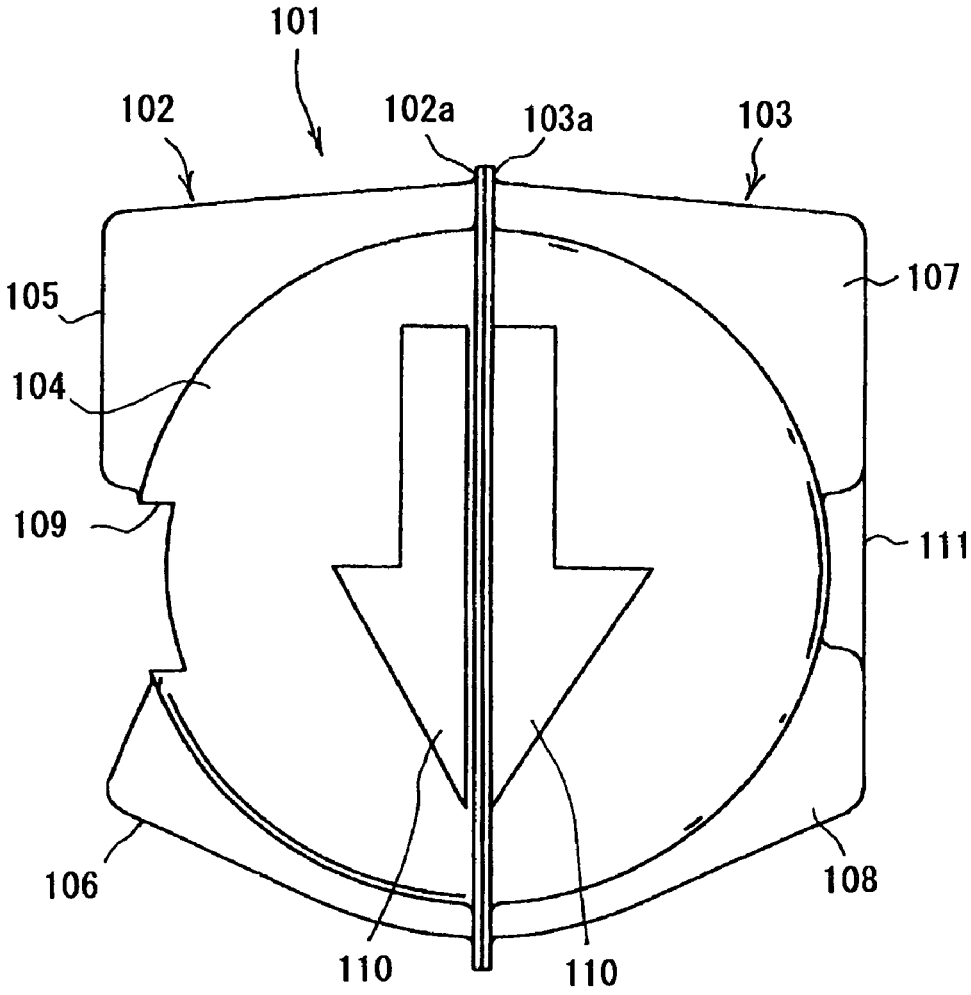
FIG. 14 is a side view of the staple case according to the fourth embodiment of the invention.
Figure 15:
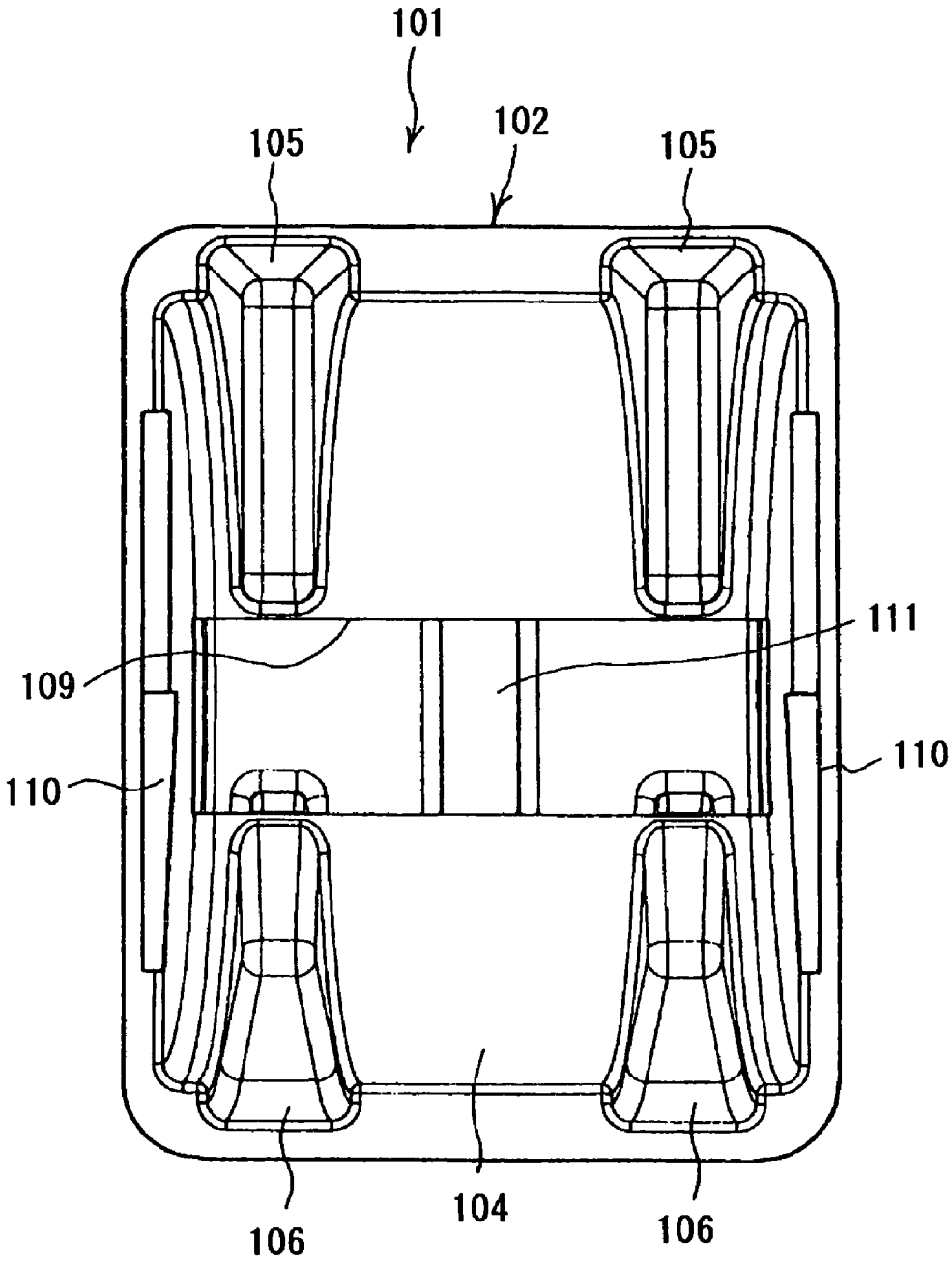
FIG. 15 is a front view of the staple case according to the fourth embodiment of the invention.
Figure 16:
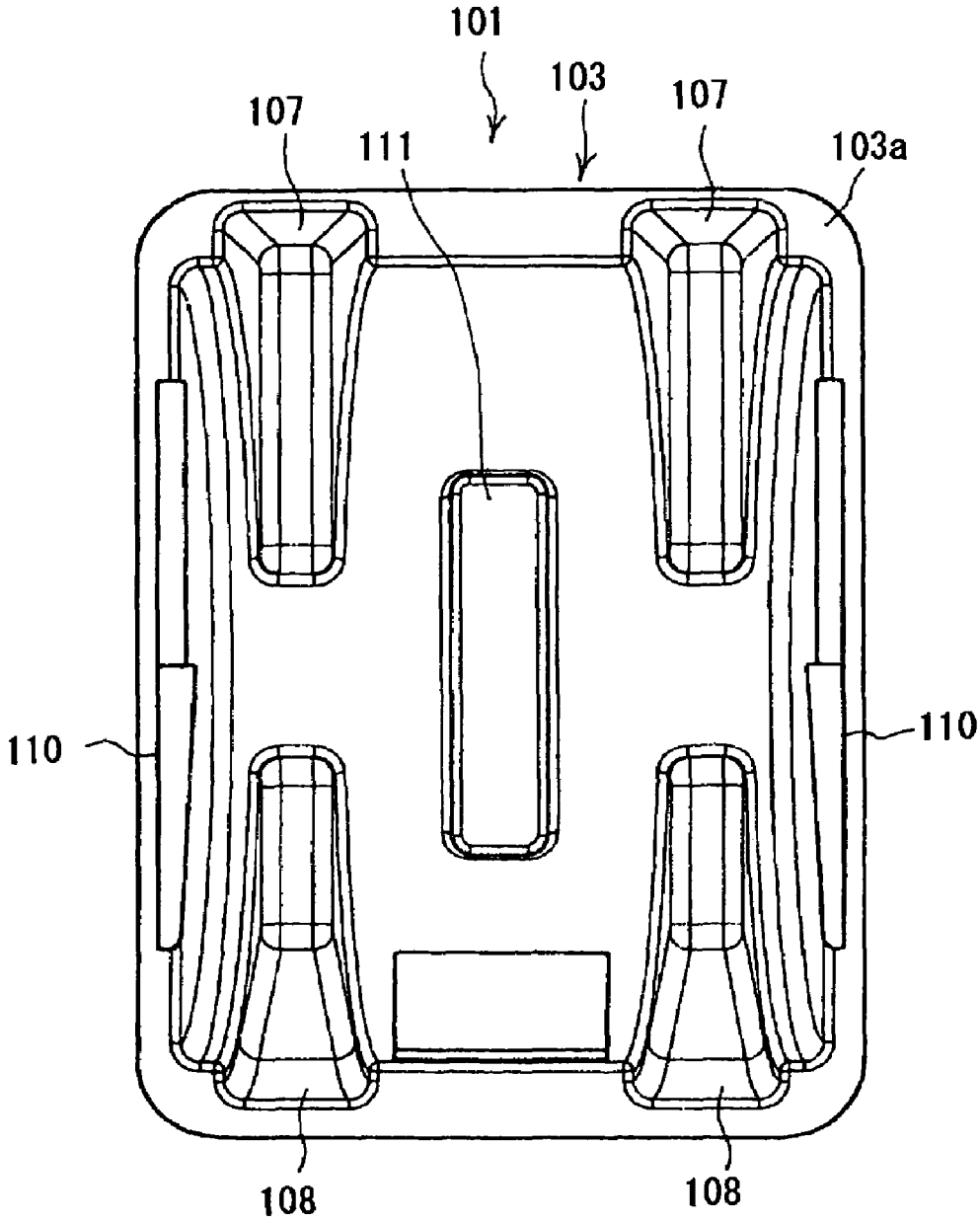
FIG. 16 is a back view of the staple case according to the fourth embodiment of the invention.
Figure 17:
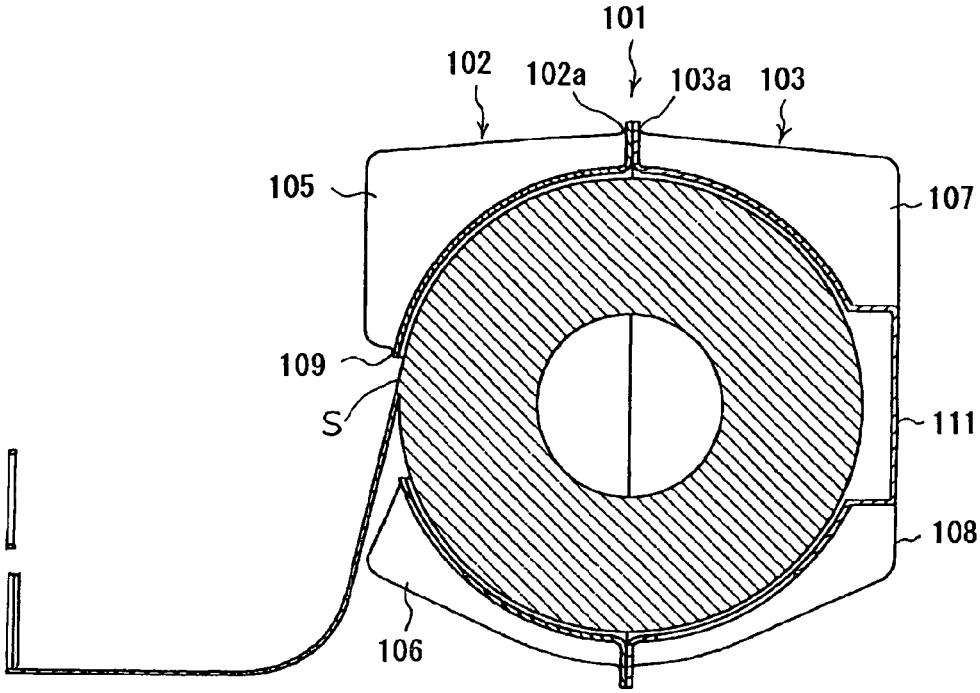
FIG. 17 is a side sectional view of the staple case according to the fourth embodiment of the invention.

As shown in FIG. 11 through FIG. 17, on both left and right side surfaces inside the roll staple containing chamber 104, hollow cushion portions 105, 106, 107, and 108 substantially squared as a whole are formed. When one or a plurality of staple cases 101 are contained in a paper box with a capacity that conform to the external dimensions of the staple case 101, the squared cushion portions 105, 106, 107, and 108 serve as packing materials, and prevent the staple case 101 from moving within the paper box. When an impact is applied from the outside, the squared cushion portions 105, 106, 107, and 108 prevent the roll staple S from being broken by absorbing the impact. As shown in FIG. 14, the upper surfaces of the upper cushion portions 105 and 107 and the bottom surfaces of the lower cushion portions 106 and 108 are made different from each other. The bottom surfaces of the lower cushion portions 106 and 108 have arcs with a curvature smaller than that of the upper surfaces of the upper cushion portions 105 and 107.

At the vertical center of the front surface of the roll staple containing chamber 104, a staple pull-out opening 109 is opened, and the roll staple S is pulled out through the staple pull-out opening 109. This staple pull-out opening 109 may be formed by forming perforations or thinned portions on the staple case 101 and removing these portions before use.

As shown in FIG. 11 and FIG. 14, the front surfaces of the front side lower cushion portions 106 below the staple pull-out opening 109 are sloped down to the front side from the staple pull-out opening 109 so that the staple is smoothly pulled out. On both left and right side surfaces of the roll staple containing chamber 104, a downward arrow mark is relief-engraved to indicate the direction of insertion into a staple cartridge. Furthermore, at the center of the back face (left of the figure) of the staple case 101, a vertically long cushion portion 111 that performs both the front and rear judging marking function and the erroneous insertion prevention function is provided so that the front face and the back face are different in shape from each other. The case where the staple case 101 is inserted into a staple cartridge is described above, and as a matter of course, it is also possible that the staple case 101 is directly inserted into a staple containing chamber of a stapler. Although illustration is omitted, by forming a weak portion such as perforations or thinned portions, etc., on the flange portions 102*a* and 103*a* at the bonded portions between the front side case half 102 and the rear side case half 103 of the staple case 101, for example, when the roll staple is broken or defective, the roll staple S can be taken out by splitting the staple case 101 into the front side case half 102 and the rear side case half 103 and can be disposed separately from the staple case 101.

Figure 18:
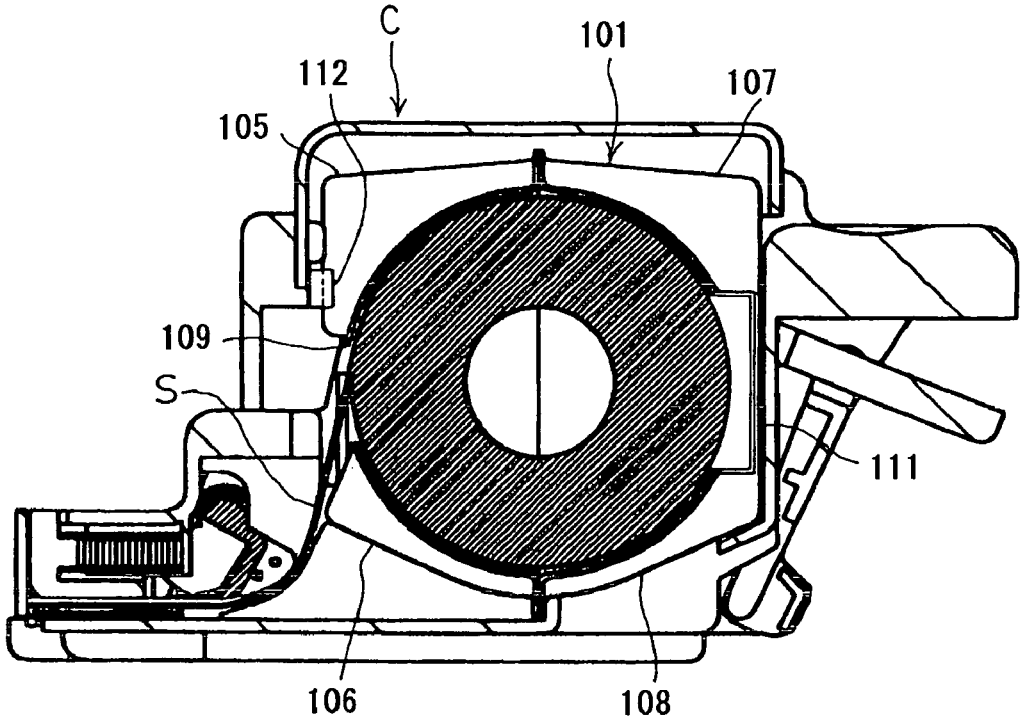
FIG. 18 is a side sectional view of a staple cartridge in which the staple case according to the fourth embodiment of the invention is loaded.

FIG. 18 shows a condition where the staple case 101 is loaded in the staple cartridge C, and the inside of the staple cartridge C has a shape and dimensions suitable for the staple case 101, so that the staple case 101 can be directly loaded by opening the upper cover without denuding the roll staple, and this makes loading extremely easy.

Furthermore, the bottom surface is concaved so as to match the shapes of the lower cushion portions 106 and 108, and at the horizontal center of the front side wall face of the staple containing chamber, a projection 112 for preventing erroneous insertion is provided. Therefore, when the staple case 101 is inserted upside down, the staple case 101 is not completely inserted into the staple containing chamber, and the upper cover of the staple cartridge C cannot be closed. When the staple case 101 is inserted by reversing its front and rear sides, the cushion portion 111 at the center of the back face of the staple case 101 comes into contact with the projection 112 and makes insertion impossible, whereby erroneous insertion is prevented.

FIFTH EMBODIMENT

Figure 19:
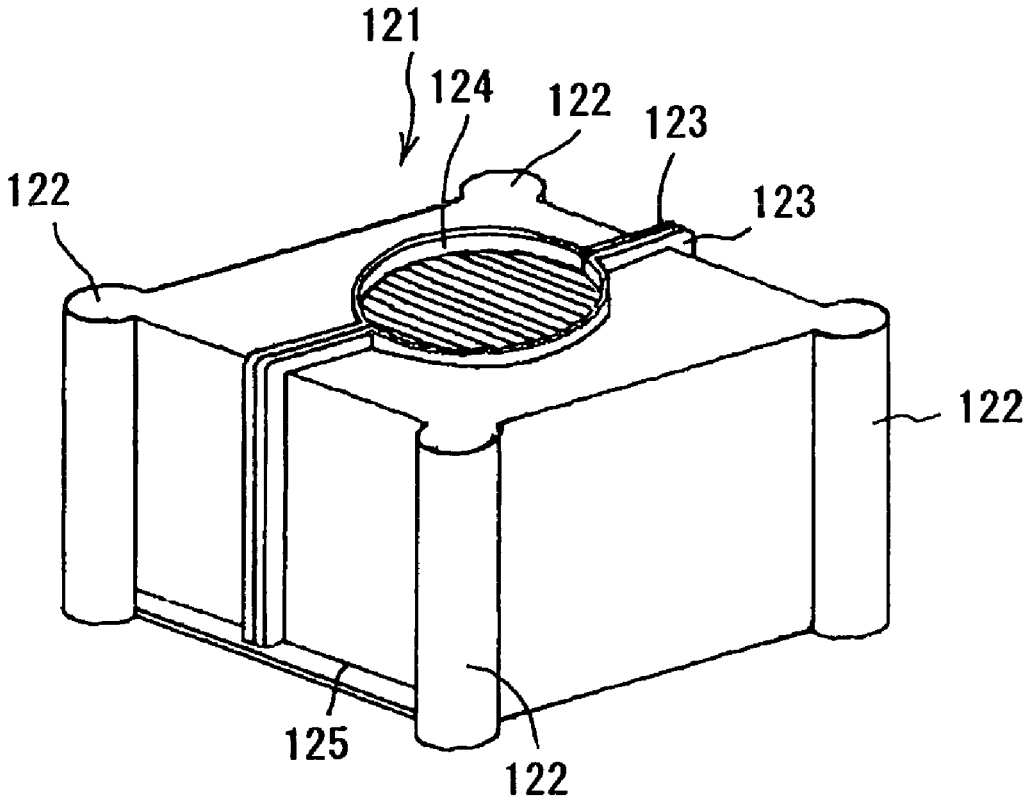
FIG. 19 is a perspective view of a staple case according to a fifth embodiment of the invention.

FIG. 19 shows a fifth embodiment of the invention, which is a staple case 121 containing layered sheet staples, wherein the four corners are protruded to form cushion portions 122, and cushion portions 123 formed of flanges of case halves are formed on the upper face and the bottom face. Into the opening 124 on the upper face, a pressing portion (not shown) provided on a stapler in which the staples are loaded is inserted, and the sheet staple pull-out opening 125 appears by removing the section surrounded by the weak portion such as perforations. This staple case can also prevent sheet staples contained therein from falling into pieces when the case is dropped or transported, and can be loaded in a stapler together with the whole staple case 121.

Various embodiments of the staple case are described above, however, the invention is not limited to the above-described embodiments, and various alterations are possible within the technical scope of the invention, and of course, this invention covers such alterations.

INDUSTRIAL APPLICABILITY

As described above, the staple case of the invention is a case containing a roll staple inside, and it is not necessary to bundle the roll staple with tape, so that removal of the tape is unnecessary when using, and the roll staple is contained in the case and prevented from being unrolled when it is dropped. In addition, the staple case has no guide path or extending part for guiding the contained roll staple to a stapler, so that the staple case is manufactured by means of blow molding or vacuum molding that keep costs low, and after the staples are used up, the case as a single material is only disposed, and it can be easily incinerated, so that the staple case saves resources and reduces environmental load. Furthermore, the roll staple can be fed from the inside of the staple case to the fore end of the staple case by the staple feed mechanism of a stapler, and therefore, the conventional operation for manually pulling the roll staple out and setting it becomes unnecessary, whereby staple supply operation becomes easy.

Furthermore, the staple case of the invention is provided with a staple pull-out opening and can be directly loaded in a staple cartridge, so that the operation for supplying staples to the staple cartridge is extremely easy, and it is not necessary to denude the roll staple, so that the fear of breakage of the roll staple when supplying staples is eliminated. In addition, the cushion portions are provided on the corners of the staple case and roughly squared, so that it is not necessary to put packing in the package box, and this provides effects of cost reduction and resource saving. In addition, the front face and the back face, and the upper face and the bottom face of the staple case are made different in shape from each other, whereby the staple case is prevented from being inserted in the wrong direction into the case containing portion of a cartridge, so that the staple supply operation becomes easy and insertion errors can be prevented.

The invention claimed is:

1. A staple case that contains a roll staple formed by connecting unformed staples in a roll shape comprising:

an opening, formed at a part of the staple case, and through which a member for rotating the roll staple is brought into contact with a circumferential surface of the roll staple, wherein a direction from a center of the roll staple to the opening and a tangent line of a portion of the roll staple where the member is brought into contact with the circumferential surface of the roll staple are substantially orthogonal; and a pull-out opening through which the roll staple is pulled out, wherein the pull-out opening is provided at the midpoint of a front face of the staple case.

2. The staple case according to claim 1, comprising:

a cushion portion.

3. The staple case according to claim 1, comprising:

a portion for positioning in a containing chamber.

4. The staple case according to claim 1, comprising:

a guide portion for guiding the staple case to a containing chamber.

5. The staple case according to claim 1, comprising:

a first case half; and a second case half.

6. The staple case according to claim 5, further comprising:

a first opening synonymous with the pull-out opening through which the roll staple is pulled out; and a second opening synonymous with the opening through which a member for rotating the roll staple is brought into contact with the roll staple, wherein the first opening is provided on one of the first case half and the second case half, and the second opening is provided on one of the other of the first case half and the second case half.

7. The staple case according to claim 5, further comprising:

a weak portion on a joint between the first case half and second case half.

8. The staple case according to claim 1, comprising:

a mark indicating a direction in which the staple case is inserted into a stapler on a side face of the staple case;

an upper face; and a bottom face having a different shape to the upper face.

9. The staple case according to claim 1, comprising:

a mark indicating a direction in which the staple case is inserted into a stapler on a side face of the staple case;

a front face; and a back face having a different shape to the front face.

10. The staple case according to claim 1, wherein the staple case is attachable to and detachable from an electric stapler.

11. The staple case according to claim 1, wherein the staple case is attachable to and detachable from a staple cartridge that is attachable to and detachable from an electric stapler.

12. The staple case according to claim 1, wherein the direction from the center of the roll staple to the pull-out opening and a direction in which the roll staple is fed out from the pull-out opening are substantially orthogonal.

* * * * *